US010077945B2

(12) United States Patent
Lan

(10) Patent No.: US 10,077,945 B2
(45) Date of Patent: Sep. 18, 2018

(54) HEAT DISSIPATION DEVICE

(71) Applicant: ASIA VITAL COMPONENTS CO., LTD., New Taipei (TW)

(72) Inventor: Wen-Ji Lan, New Taipei (TW)

(73) Assignee: ASIA VITAL COMPONENTS CO., LTD., New Taipei (TW)

( * ) Notice: Subject to any disclaimer, the term of this patent is extended or adjusted under 35 U.S.C. 154(b) by 0 days.

(21) Appl. No.: 15/166,279

(22) Filed: May 27, 2016

(65) Prior Publication Data

US 2017/0343297 A1 Nov. 30, 2017

(51) Int. Cl.
*F28D 15/02* (2006.01)
*F28D 15/04* (2006.01)
*F28D 21/00* (2006.01)

(52) U.S. Cl.
CPC ..... *F28D 15/0233* (2013.01); *F28D 15/0266* (2013.01); *F28D 15/046* (2013.01); *F28D 2021/0028* (2013.01)

(58) Field of Classification Search
CPC .. F28D 15/04; F28D 15/0266; F28D 15/0233; F28D 2021/0028; F28D 15/0275; F28F 9/013; F28F 9/0136
USPC ..... 165/104.26
See application file for complete search history.

(56) References Cited

U.S. PATENT DOCUMENTS 7,958,935 B2 * 6/2011 Belits ..... F28D 15/0266 165/104.21
2006/0283577 A1 * 12/2006 Liu ..... F28D 15/043 165/104.26
2007/0107878 A1 * 5/2007 Hou ..... F28D 15/025 165/104.26
2007/0199682 A1 * 8/2007 Hwang ..... F28D 15/046 165/104.26
2007/0227703 A1 * 10/2007 Bhatti ..... F28D 15/02 165/104.26
2008/0078530 A1 * 4/2008 Chang ..... F28D 15/043 165/104.26
2008/0283223 A1 * 11/2008 Chang ..... F28D 15/043 165/104.26
2009/0020269 A1 * 1/2009 Chang ..... F28D 15/046 165/104.26
2009/0242174 A1 * 10/2009 McCutchen ..... F28D 15/0233 165/104.25
2011/0067844 A1 * 3/2011 Meyer, IV ..... F28D 15/0233 165/104.26

(Continued)

*Primary Examiner* — Raheena R Malik

(74) *Attorney, Agent, or Firm* — Jackson IPG PLLC; Demian K. Jackson

(57) ABSTRACT

A heat dissipation device includes a first and a second housing, at least one pipe, and a working fluid. The first and the second housing internally respectively defines a first and a second chamber, in which a first and a second wick structure is respectively formed, and has at least one first and second opening communicated with the first and the second chamber respectively. The pipe has a pipe body, and a first and second extended portion, which respectively has a first and a second open end, and a first and a second through opening, and is inserted into and connected to the first and the second chamber via the first and the second opening respectively. The pipe internally defines a pipe chamber, in which a pipe wick structure is formed. The working fluid is provided in the first and the second, and the pipe chamber.

11 Claims, 18 Drawing Sheets

(56) References Cited

U.S. PATENT DOCUMENTS

| | | | | |
|---|---|---|---|---|
| 2012/0043060 | A1* | 2/2012 | Wang | F28D 15/0266 165/104.26 |
| 2012/0111538 | A1* | 5/2012 | Wang | F28D 15/0266 165/104.21 |
| 2012/0291997 | A1* | 11/2012 | Chen | H01L 23/473 165/104.13 |
| 2012/0325440 | A1* | 12/2012 | Honmura | F28F 21/084 165/104.26 |
| 2013/0168058 | A1* | 7/2013 | Chamseddine | F28D 7/0075 165/104.26 |
| 2014/0138058 | A1* | 5/2014 | Hyde | F28D 15/04 165/104.26 |
| 2014/0182819 | A1* | 7/2014 | Yang | F28D 15/02 165/104.26 |
| 2015/0083361 | A1* | 3/2015 | Gal | F24J 3/08 165/45 |
| 2016/0128234 | A1* | 5/2016 | Uesugi | H05K 7/20336 361/700 |

* cited by examiner

HEAT DISSIPATION DEVICE

FIELD OF THE INVENTION

The present invention relates to a heat dissipation device, and more specifically, to a heat dissipation device that can have no interface thermal resistance at junctures between the first and the second housing, and the pipe, have enhanced heat transfer efficiency, have increased vapor/liquid circulation effect, be manufactured at lower costs, and remove heat more quickly.

BACKGROUND OF THE INVENTION

The currently available electronic mobile devices have become extremely thin and light. Apart from being thin and light, the new-generation electronic mobile devices have also largely improved computation performance. Due to the improved computation performance and the largely reduced overall thickness, an internal space of the electronic mobile devices for disposing electronic elements is also limited. The higher the computation performance is, the more amount of heat the electronic elements produce during operation. Therefore, vapor chambers and heat pipes are widely used to dissipate the heat produced by the electronic elements.

A vapor chambers normally has a rectangle housing, which has a wick structure and a working fluid provided therein. One side of the housing, i.e. the evaporating section, is attached to a heat-generating element, such as a central processing unit (CPU), south/north bridge chipset, or transistor, to absorb heat produced by the heat-generating element and then evaporated. Thereafter, the evaporated heat is dissipated via a condensing section and condensed into liquid due to capillary force, then flowed back to the evaporating section to complete the whole inclosed circulation.

The operating principle of a heat pipe is similar to the vapor chamber ○ The heat pipe dissipates heat mainly through a vapor-liquid circulation occurred therein. More specifically, the heat pipe has an evaporating and a condensing end. The evaporating end is in contact with a heat generating element, such that the working fluid located at the evaporating end is heated and vaporized. The vaporized working fluid flows through the chamber to the condensing end, at where the working fluid is condensed into liquid. The liquid working fluid then flows back to the evaporating end with the help of a capillary force of the wick structure.

The difference between the heat pipe and the vapor chamber is that the vapor chamber helps spreads the heat in two dimensions across the vapor chamber area (in-plane spreading) and also conducts the heat in a vertical direction (through-plane), but the heat pipe dissipates the heat only in one dimension, i.e. distant heat dissipation. Currently, only one heat pipe or one vapor chamber attached to electronic elements cannot meet the requirement of heat dissipation. It is therefore tried by the inventor to develop how to combine the heat pipe with the vapor chamber to increase the heat transfer effect.

It is therefore tried by the inventor to develop an improved heat dissipation device to overcome the drawbacks and problems in the conventional heat dissipation device.

SUMMARY OF THE INVENTION

To solve the above problems, a primary object of the present invention is to provide a heat dissipation device that can have no interface thermal resistance at junctures between a pipe, and a first and a second housing with the pipe arranged between the first and the second housing.

Another object of the present invention is to provide a heat dissipation device that can have a condensed liquid working fluid flow back with the help of a capillary force and gravity to achieve improved heat transfer efficiency since a pipe wick structure of the pipe is connected to the first and the second wick structure of the first and the second housing.

A further object of the present invention is to provide a heat dissipation device that can quickly diffuse heat with assembled a first and a second heat radiation fin assembly, so as to enhance heat transfer effect.

To achieve the above and other objects, the heat dissipation device provided according to the present invention includes a first and a second housing, at least one pipe, and a working fluid. The first housing internally defines a first chamber, in which a first wick structure is formed, and has at least one first opening communicated with the first chamber, whereas the second housing internally defines a second chamber, in which a second wick structure is formed, and has at least one second opening communicated with the second chamber. The pipe has a pipe body, and a first and second extended portion formed on the two opposite end thereof. The first and the second extended portion has a first and a second open end, and a first and a second through opening, and is inserted into and connected to the first and the second chamber via the first and the second opening of the first and the second housing respectively. The pipe body internally defines a pipe chamber, in which a pipe wick structure is formed. The working fluid is provided in the first and the second, and the pipe chamber. Furthermore, since there is no interface thermal resistance at junctures between the first and the second housing, and the pipe, the heat transfer efficiency of the heat dissipation device can be largely enhanced.

BRIEF DESCRIPTION OF THE DRAWINGS

The structure and the technical means adopted by the present invention to achieve the above and other objects can be best understood by referring to the following detailed description of the preferred embodiments and the accompanying drawings, wherein.

DETAILED DESCRIPTION OF THE PREFERRED EMBODIMENTS

Figure 1:
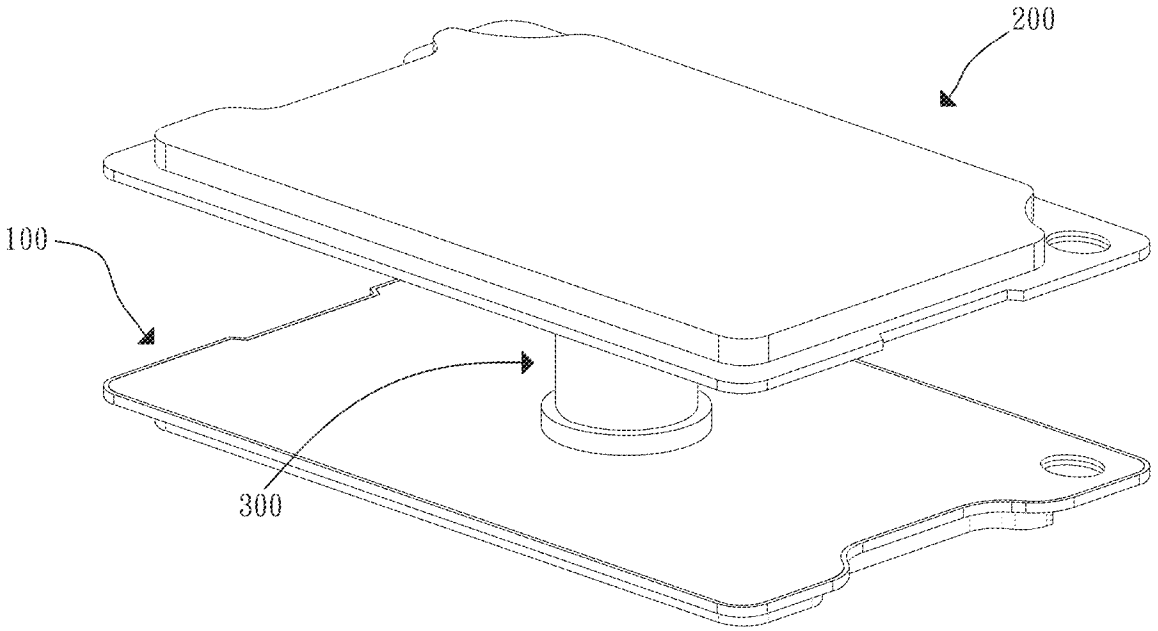
FIG. 1 is an assembled perspective view of a first embodiment of a heat dissipation device according to the present invention.

The present invention will now be described with some preferred embodiments thereof and by referring to the accompanying drawings. For the purpose of easy to understand, elements that are the same in the preferred embodiments are denoted by the same reference numerals.

Figure 2:
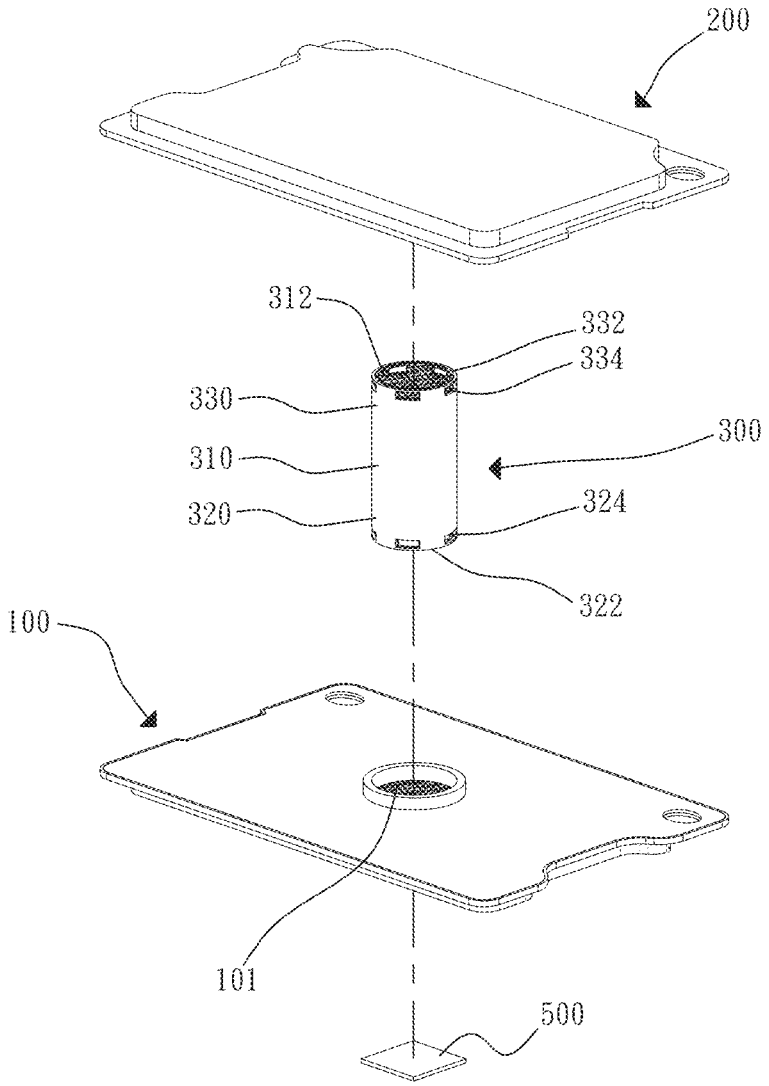
FIG. 2 is an exploded perspective view of FIG. 1.
Figure 2A:
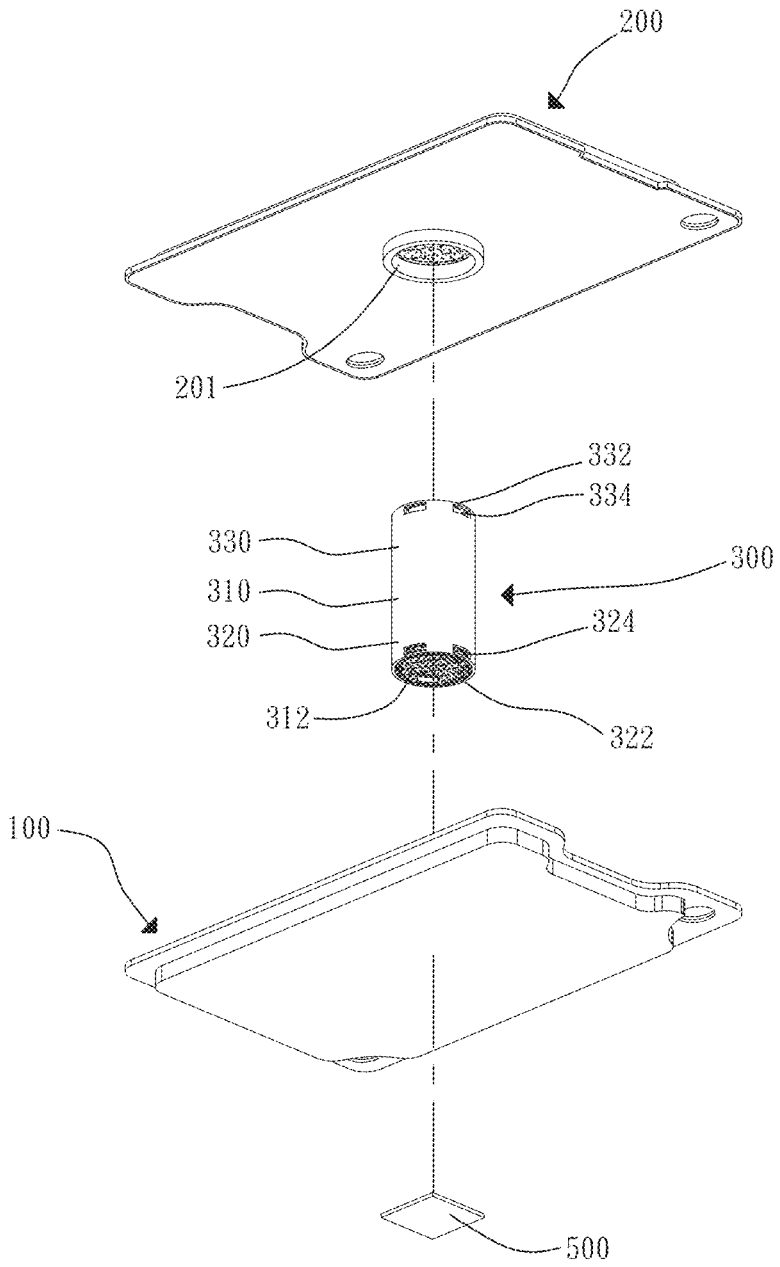
FIG. 2*a* is an exploded perspective view of FIG. 1 from another angle.
Figure 3:
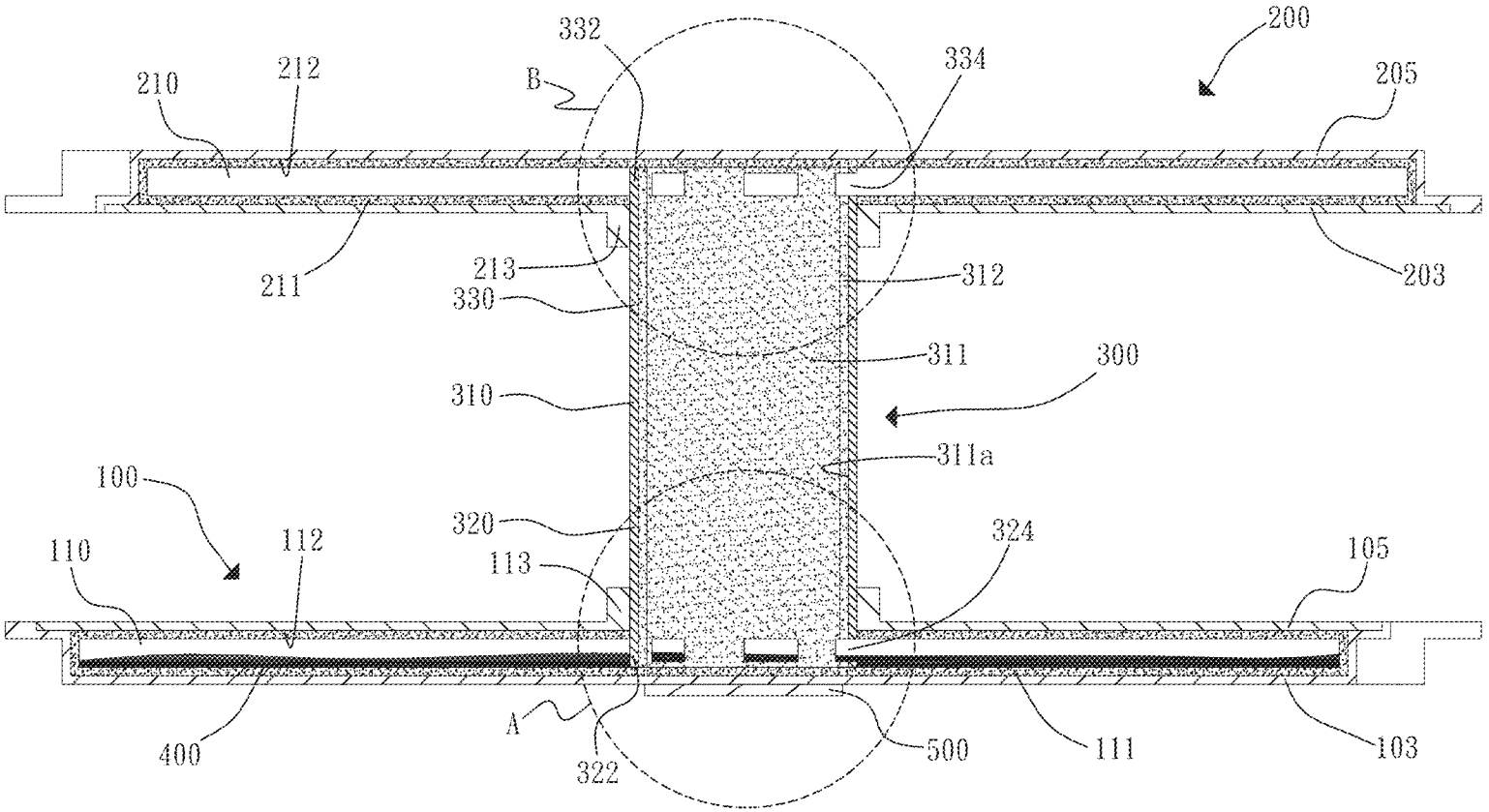
FIG. 3 is an assembled sectional view of the first embodiment of the heat dissipation device according to the present invention.
Figure 4:
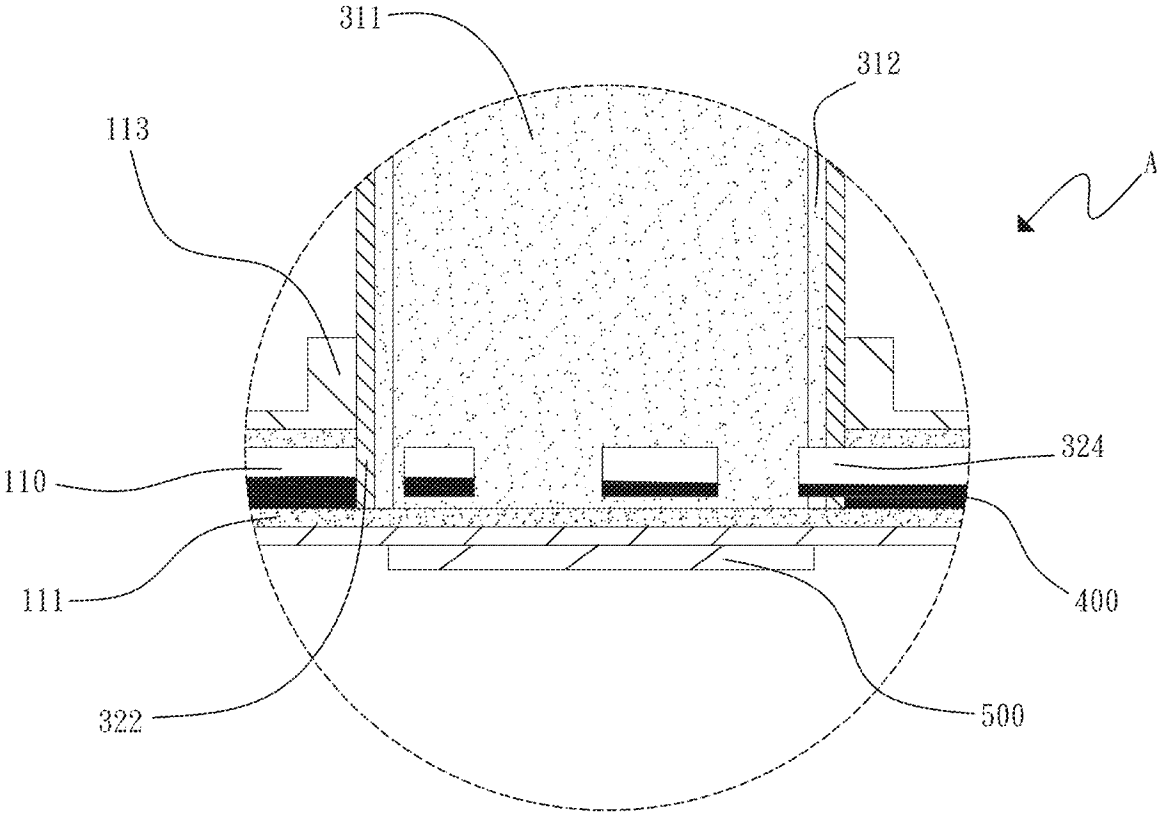
FIGS. 4 and 5 are two enlarged views, respectively, of the circled area A and B in FIG. 3.
Figure 5:
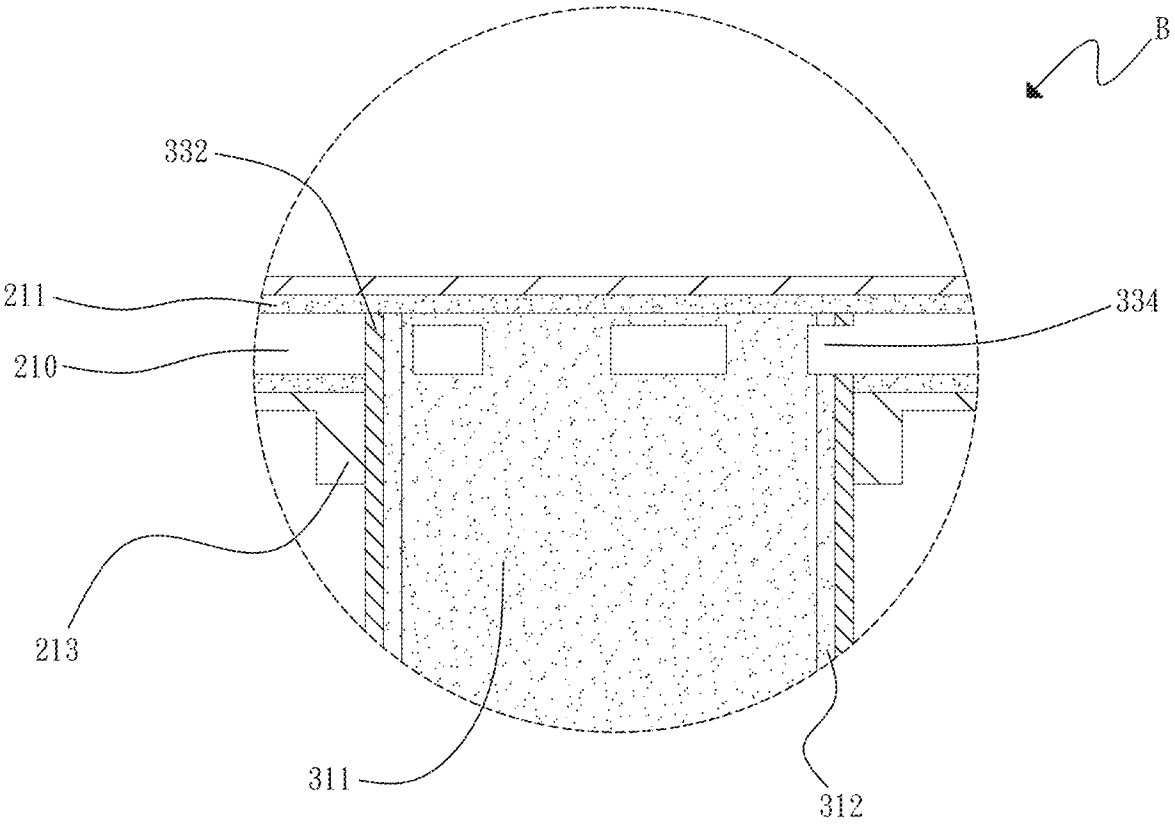

Please refer to FIGS. 1, 2, 2*a*, which are assembled and exploded perspective views, respectively, of a heat dissipation device according to a first embodiment of the present invention, and FIGS. 3 to 5, which are assembled sectional and two partially enlarged views, respectively, of the heat dissipation device according to the first embodiment of the present invention. As shown, the heat dissipation device includes a first and a second housing 100, 200, at least one pipe 300, and a working fluid 400.

In this illustrative first embodiment, the first and the second housing 100, 200 can be, for example but not limited to, a vapor chamber or other materials that can provide the same effect in practical implementation.

The first housing 100 has a first top side 105, a first bottom side 103, which are closed to each other to internally define a first chamber 110, and at least one first opening 101. The first chamber 110 is provided with a first wick structure 111 on a first housing inner wall 112 thereof. The first wick structure 111 is preferably but not limited to sintered powder structure; however; in practical implementation, it can be grid structure, fiber structure, braided structure, or any combination of thereof.

Moreover, the first opening 101 is provided on the first top side 105 of the first housing 100 and extended through and communicated with the first chamber 110. In this illustrated first embodiment, the number of the first opening 101 is, for example but not limited to, one and can be one or more in practical implementation.

The second housing 200 has a second top side 205, a second bottom side 203, which are closed to each other to internally define a second chamber 210, and at least one second opening 201. The second chamber 210 is provided with a second wick structure 211 on a second housing inner wall 212 thereof. The second wick structure 211 is preferably but not limited to sintered powder structure; however; in practical implementation, it can be grid structure, fiber structure, braided structure, or any combination of thereof.

Moreover, the second opening 202 is provided on the second top side 205 of the second housing 200 and extended through and communicated with the second chamber 210. In this illustrated first embodiment, the number of the second opening 201 is, for example but not limited to, one and can be one or more in practical implementation.

The pipe 300 has a pipe body 310, and a first and second extended portion 320, 330 formed on the two opposite end thereof. The pipe 300 can preferably be, for example but not limited to, a heat pipe, or other materials that can provide the same effect. The first extended portion 320 has a first open end 322 and a first through opening 324, and is inserted into and connected to the first chamber 110 via the first opening 101 of the first housing 100, whereas the second extended portion 330 has a second open end 332 and a second through opening 334, and is inserted into and connected to the second chamber 210 via the second opening 201 of the second housing 200. The pipe body 310 internally defines a pipe chamber 310, which is located between the first and the second open end 322, 332, and has a pipe wick structure 312, which is formed on a pipe inner wall 311*a* in the pipe chamber 311. The pipe wick structure 312 is preferably but not limited to sintered powder structure; however; in practical implementation, it can be grid structure, fiber structure, braided structure, or any combination of thereof.

The working fluid 400 is provided in the first and the second chamber 110, 210, and the pipe chamber 311. The working fluid 400 is preferably but not limited to pure water or methanol; however; in practical implementation, it can be other materials that can provide the same effect. Since the first and the second housing 100, 200 is connected to the pipe 300, and the first and the second chamber 110, 210 and the pipe chamber 311 are communicable one another, there is no interface thermal resistance at junctures between them.

Also, the first extended portion 320 is inserted into the first chamber 110 via the first opening 101 of the first housing 100, so the first open end 322 is pressed against the first wick structure 111 on the first bottom side 103 of the first housing 100, whereas the second extended portion 330 is inserted into the second chamber 210 via the second opening 201 of the second housing 200, so the second open end 332 is pressed against the second wick structure 211 on the second top side 205 of the second housing 200. That is, the first and the second extended portion 310, 320 is respectively extended to the first bottom side 103 and the second top side 205 via the first and the second opening 101, 201, such that the first open end 322 can be connected to the first wick structure 111 on the first bottom side 103 of the first housing 100, whereas the second open end 332 can be connected to the second wick structure 211 on the second top side 205 of the second housing 200. In addition, an outer side of the pipe body 310 is respectively tightly contact with two inner wall of the first and the second open end 101, 201. As the first and the second extended portion 320, 330 is part of the pipe body 310, a pipe inner wall 311*a* located corresponding to the first and the second extended portion 320, 330 is also part of the pipe body 310. The first and the second through opening 324, 334 is respectively extended through both an inner and an outer wall of the pipe body 310, and located respectively corresponding to the first and the second chamber 110, 210, such that the pipe chamber 311 is communicated with the first and the second chamber 110, 210. In the illustrated first embodiment, the number of the first and the second through opening 324, 334 are five, respectively, but it can be one or other quantities that can provide the same effect.

Furthermore, the pipe wick structure 312 has a wick connection connected to the first and the second wick structure 111, 211 as shown in FIGS. 4 and 5. That is, the pipe wick structure 312 on the pipe inner wall 311*a* of the pipe body 310 has the wick connection connected to the first bottom side 103 and the second top side 205, respectively, of the first and the second housing 100, 200 at the first and the second open end 322, 332, respectively, of the first and the second extended portion 320, 330 of the pipe 300. The wick connection here is referred to the porous structure in the first and the second wick structure 111, 211 is connected to and communicated with the porous structure in the pipe wick structure 312, so capillary force of the pipe wick structure 312 can be transferred or extended to the first and the second wick structure 111, 211, such that the working fluid 400 can be condensed into liquid and flowed back to the pipe wick structure 312 then the first wick structure 111 of the first chamber 110 with the help of a capillary force and gravity.

With the pipe wick structure 312 has the wick connection connected with the first and the second wick structure 111, 211, the condensed working fluid 400 in the first chamber 110 can quickly flow back to the second wick structure 211 of the second chamber 211 with the help of a capillary force and gravity of the pipe wick structure 312 of the pipe 300, or the condensed working fluid 400 in the second chamber 210 can quickly flow back to the first wick structure 111 of the first chamber 110 with the help of a capillary force and gravity of the pipe wick structure 312 of the pipe 300.

When a heat generating element 500, such as central processing unit (CPU), microcontroller unit (MCU), or other electronic elements, is attached to the first bottom side 103 of the first housing 100, heat produced by the heat generating element 500 is absorbed by the first bottom side 103 of the first housing 100, such that the working fluid 400 located at the first wick structure 111 on the first inner wall 112 of the first bottom side 103 of the first housing 100 is heated and vaporized. The vaporized working fluid 400 flows towards the first top side 105 of the first chamber 110. Meanwhile, a part of the vaporized working fluid 400 flows through the first open end 322 of the pipe 300 into the pipe chamber 311, and another part of the vaporized working fluid 300 flows through the pipe chamber 311 into the second chamber 210. The working fluid 400 is then condensed into liquid at the first top side 105 in the first chamber 110 of the first housing 100, the pipe chamber 311 of the pipe 300, and the second chamber 210. The liquid working fluid 400 at the second chamber 210 of the second housing 200 and the pipe chamber 311 of the pipe 300 then quickly flows back to the first wick structure 111 on the first bottom side 103 of the first chamber 110 with the help of a capillary force and gravity of the second wick structure 211 and the pipe wick structure 312. Therefore, the vapor-liquid circulation of the working fluid 400 is occurred in the first and the second chamber 110, 210, and the pipe chamber 311 over and over again to achieve improved heat dissipation effect.

The first housing 100 further includes at least one first raised portion 113, which is adjacent to the first opening 101 and upwardly extended from the first top side 105 of the first housing 100. The first opening 101 of the first housing 100 has an inner wall correspondingly in tightly contact with the outer wall of the first extended portion 320 of the pipe 300. Also, the second housing 200 further includes at least one second raised portion 213, which is adjacent to the second opening 201 and downwardly extended from the second bottom side 203 of the second housing 200. The second opening 201 of the second housing 200 has an inner wall correspondingly in tightly contact with the outer wall of the second extended portion 330 of the pipe 300. The first and the second raised portion 113, 213 give the pipe 300 an increased connecting area. With the large connecting area, the pipe 300 can be fixedly fitted in the first and the second housing 100, 200.

Figure 6:
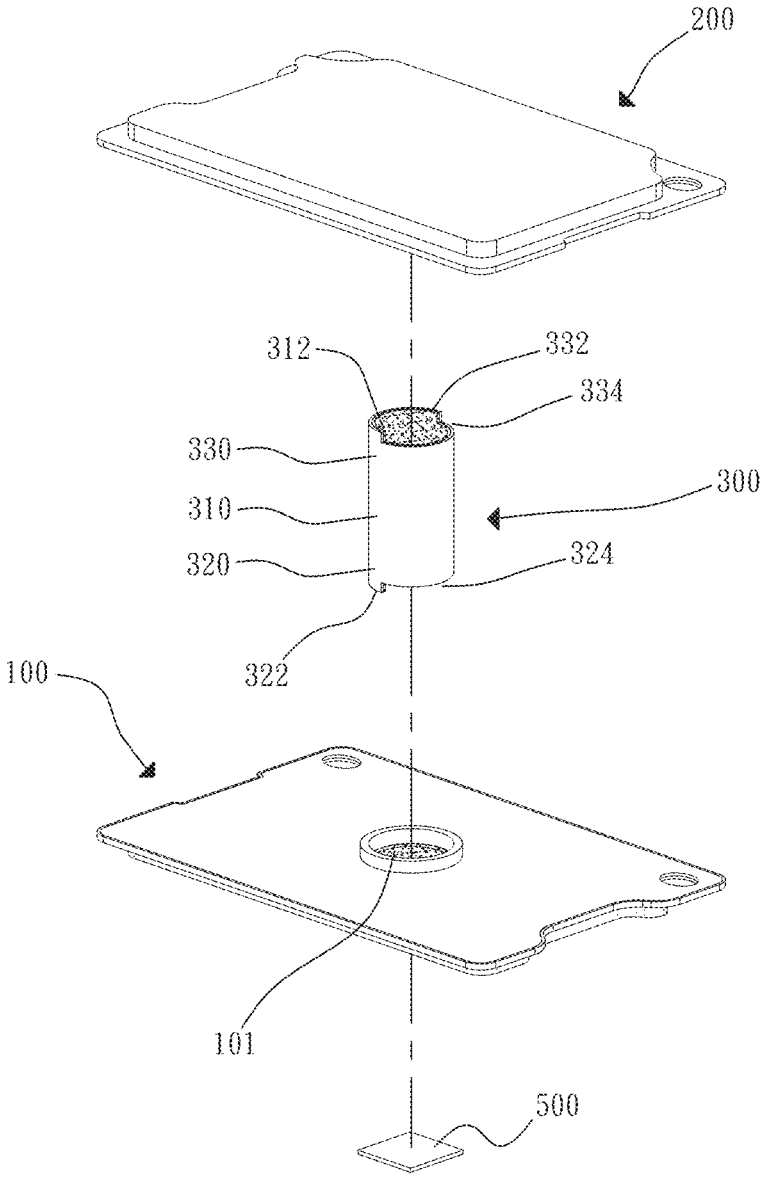
FIG. 6 is an exploded perspective view of a second embodiment of the heat dissipation device according to the present invention.
Figure 7:
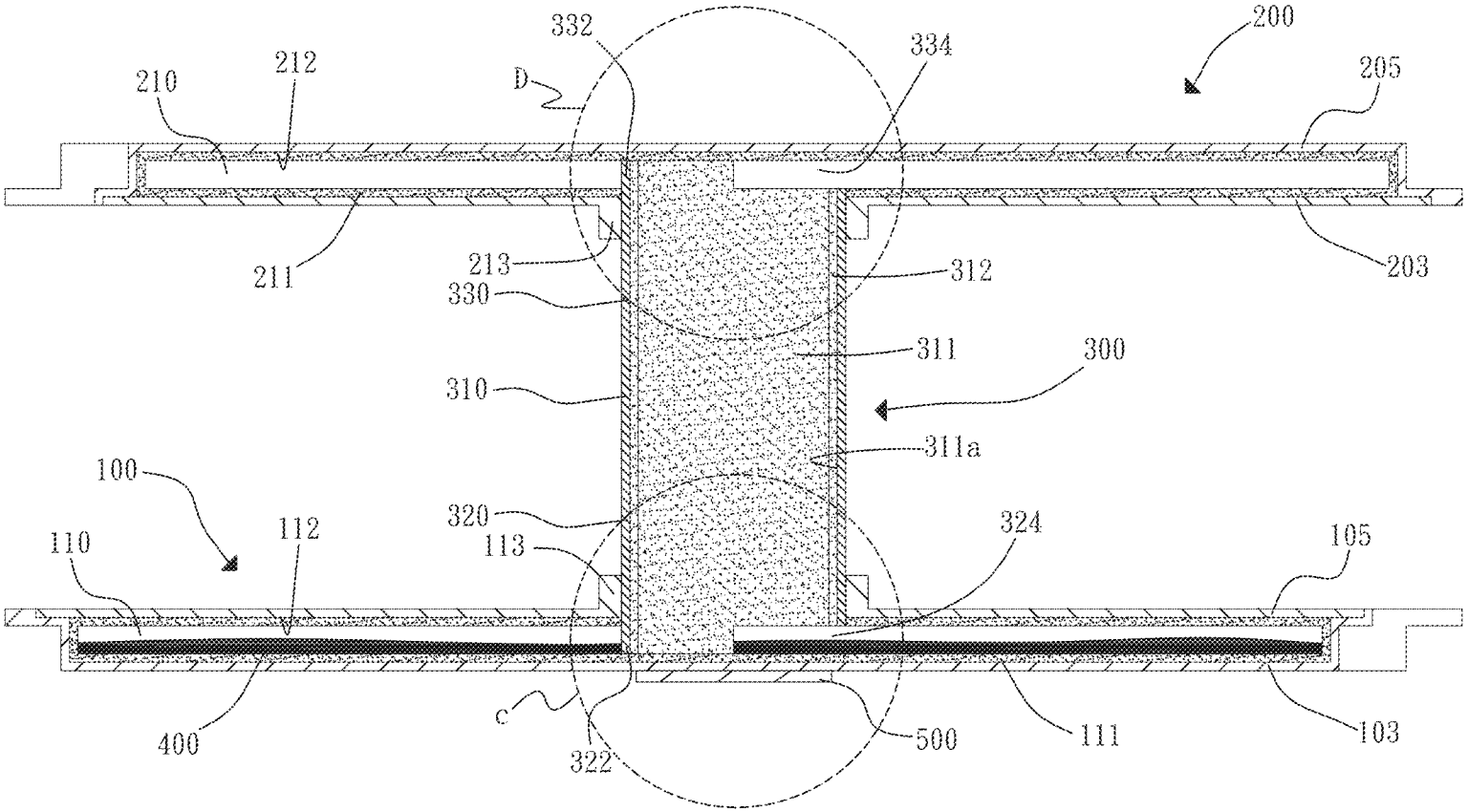
FIG. 7 is an assembled sectional view of the second embodiment of the heat dissipation device according to the present invention.
Figure 8:
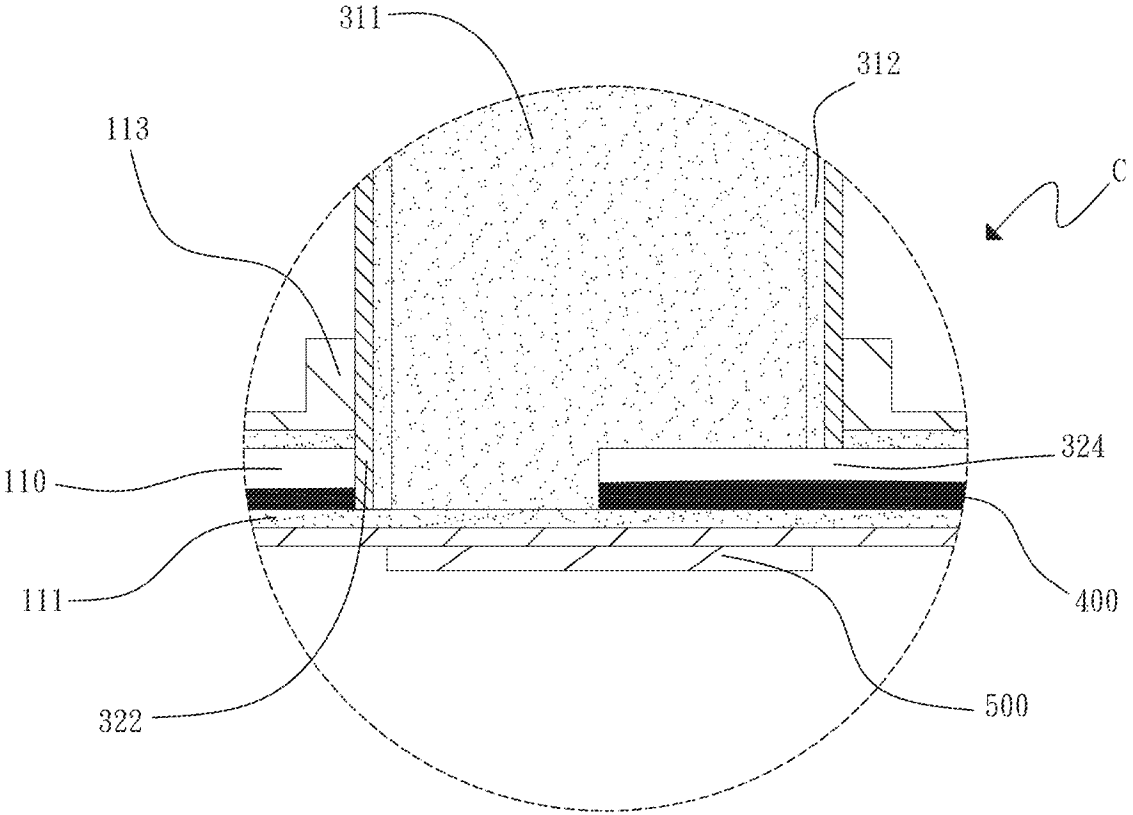
FIGS. 8 and 9 are two enlarged views, respectively, of the circled area C and D in FIG. 7.
Figure 9:
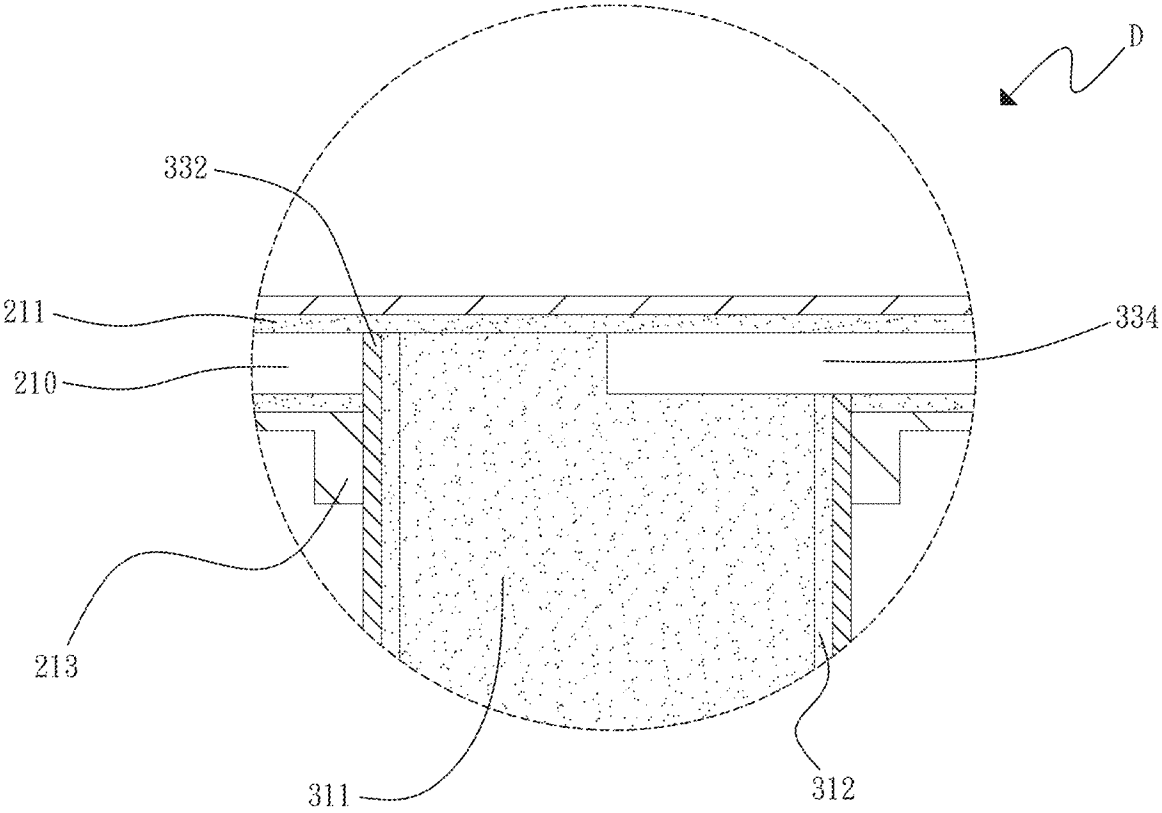

Please refer to FIGS. 6 and 7, which are exploded perspective and assembled sectional views, respectively, of the heat dissipation device according to a second embodiment of the present invention, and FIGS. 8 and 9, which are two partially enlarged views, respectively, of the heat dissipation device according to the first embodiment of the present invention, along with FIG. 1. As shown, the second embodiment of the heat dissipation base is generally structurally similar to the first embodiment except that, in this second embodiment, only one first and one second through opening 324, 334 are provided. The first and second chamber 110, 210 can communicated with the pipe chamber 311 with the through opening 324, 334 to achieve the same effect mentioned in the first embodiment.

Figure 10:
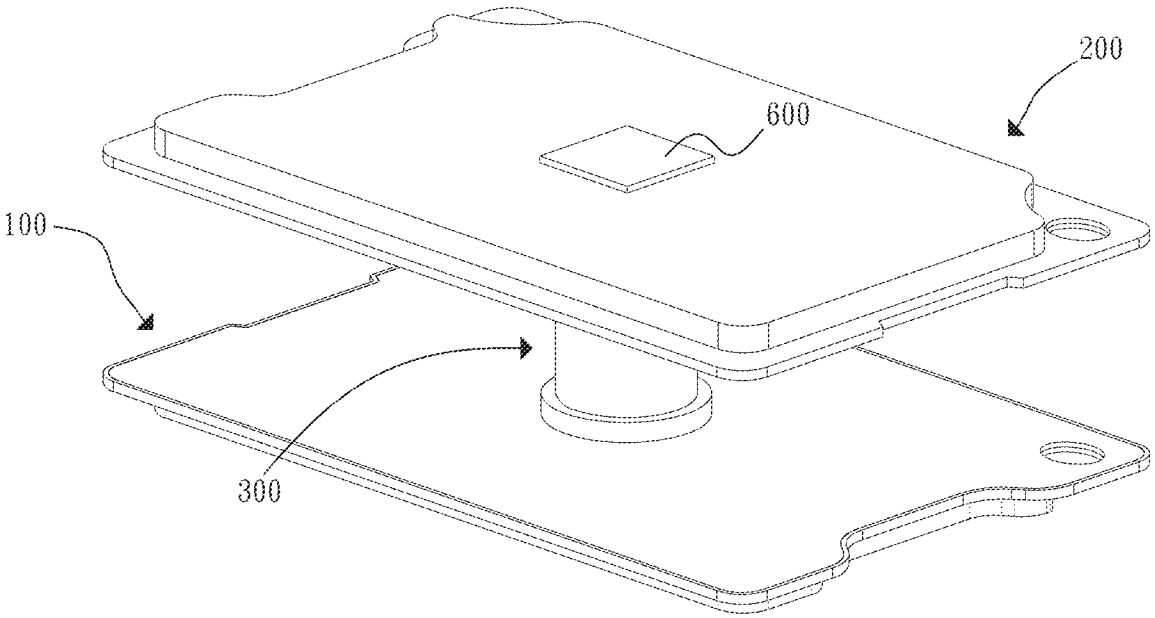
FIG. 10 is an assembled perspective view of a third embodiment of the heat dissipation device according to the present invention.

Please refer to FIG. 10, which is an assembled perspective view of the heat dissipation device according to a third embodiment of the present invention, along with FIGS. 2 to 9. As shown, the third embodiment of the heat dissipation base is generally structurally similar to the first and the second embodiments except that, in this third embodiment, a second heat generating element 600 is attached to the second top side 205 of the second housing 200 and the first chamber 110 of the first housing 100 acts as the condensing chamber used to condense the vaporized working fluid 400 to achieve the same effect mentioned in the first and the second embodiments as well. Also, it can also achieve the same heat dissipation effect that the two heat generating elements are respectively attached to the first bottom side 103 of the first housing 100 and the second top side 205 of the second housing 200 (not shown).

Figure 11:
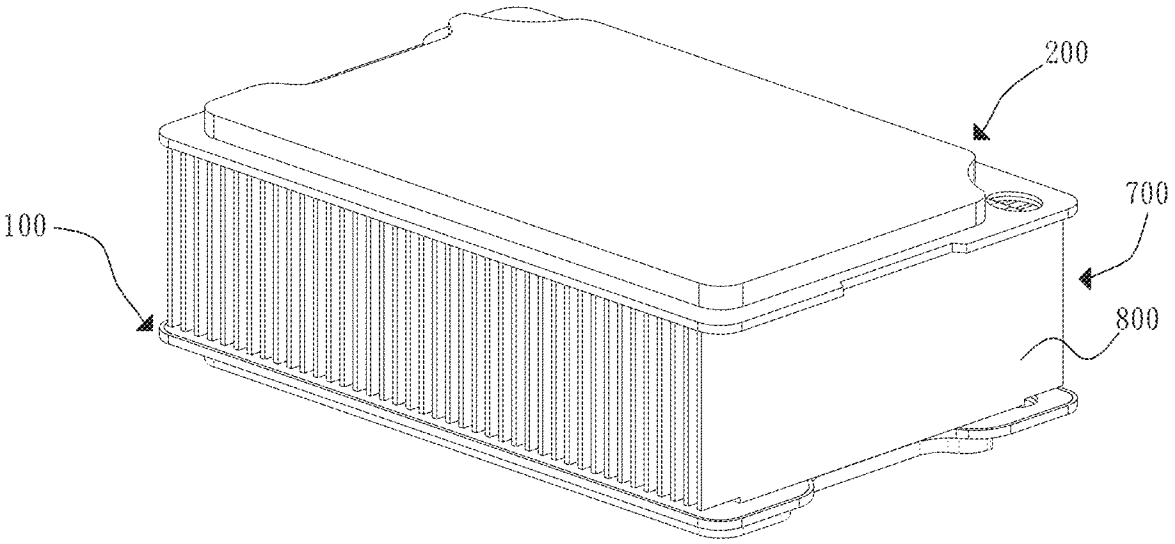
FIG. 11 is an assembled perspective view of a fourth embodiment of the heat dissipation device according to the present invention.

Please refer to FIG. 11, which is an assembled perspective view of the heat dissipation device according to a fourth embodiment of the present invention, along with FIGS. 2 to 9. As shown, the fourth embodiment of the heat dissipation base is generally structurally similar to the first, the second, and the third embodiments except that, in this fourth embodiment, an open space 700 is defined between the first and the second housing 100, 200, and the pipe 300. A first heat radiation fin assembly 800 is located in the open space 700, wherein an outer side of the first top side 105 of the first housing 100 and the outer wall of the pipe 300 are attached to the first heat radiation fin assembly 800, and an outer side of the second bottom side 203 of the second housing 200 is attached to a top side of the first heat radiation fin assembly 800. The first heat radiation fin assembly 800 gives an increased contact area with the surrounding air. With the first heat radiation fin assembly 800, the heat can quickly removed from the first top side 105, the second bottom side 203, and the pipe body 311 into the surrounding air largely to enhance the overall heat dissipation efficiency of the first and the second housing 100, 200.

Figure 12:
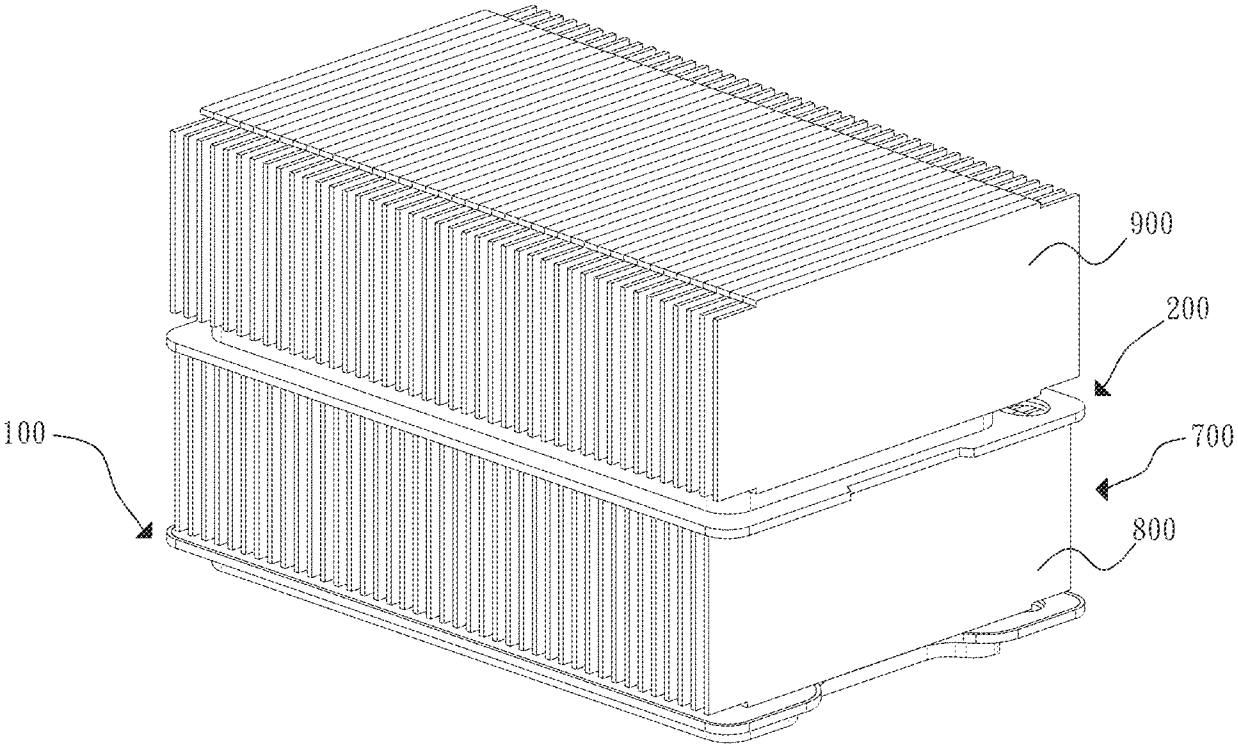
FIG. 12 is an assembled perspective view of a fifth embodiment of the heat dissipation device according to the present invention.
Figure 13:
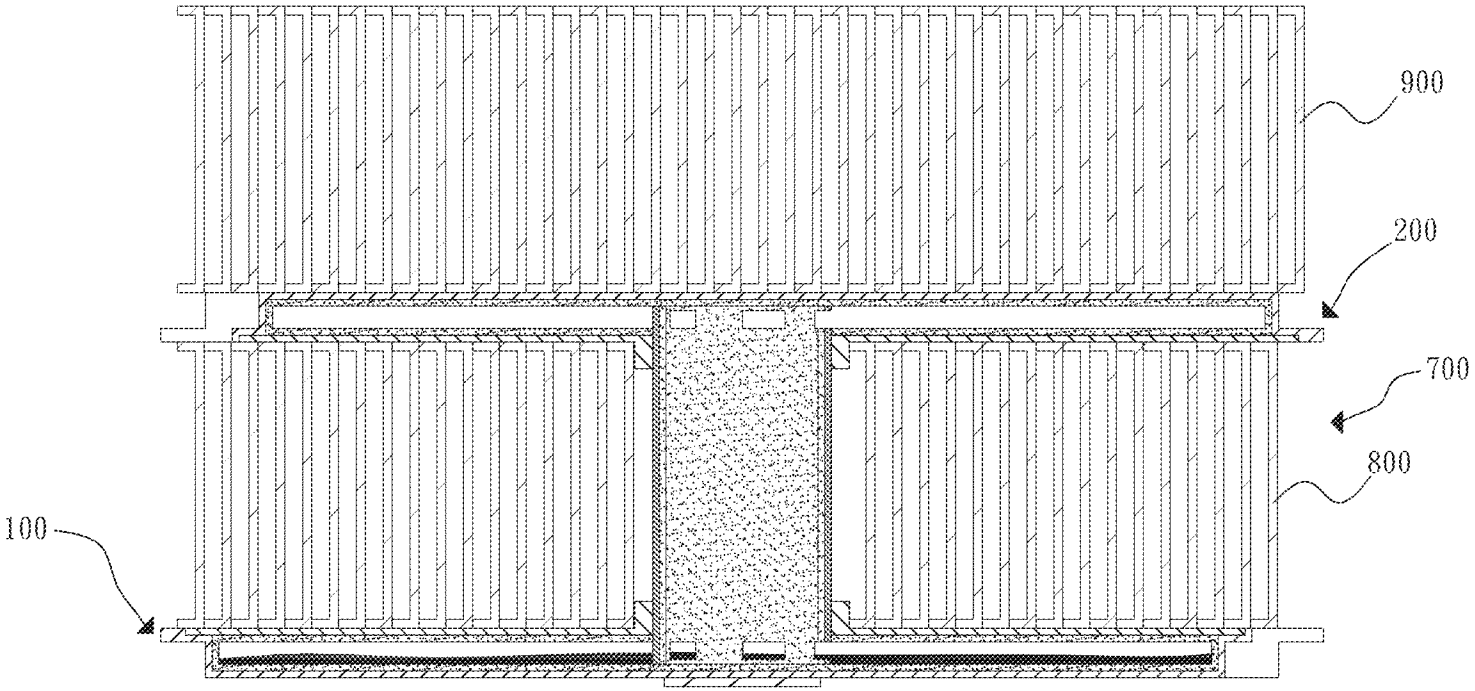
FIG. 13 is an assembled sectional view of the fifth embodiment of the heat dissipation device according to the present invention.

Please refer to FIGS. 12 and 13, which are assembled perspective and assembled sectional views, respectively, of the heat dissipation device according to a fifth embodiment of the present invention, along with FIGS. 2 to 9. As shown, the fifth embodiment of the heat dissipation base is generally structurally similar to the fourth embodiment except that, in this fifth embodiment, when a second heat radiation fin assembly 900 instead of the second heat generating element 600 is attached to the second top side 205 of the housing 200, an outer side of the second top side 205 of the second housing 200 is attached to a bottom side of the second heat radiation fin assembly 900 to have an increased contact area with the surrounding air, such that the heat can quickly removed from the second top side 205 into the surrounding air largely to enhance the overall heat dissipation efficiency of the first and the second housing 100, 200.

Figure 14:
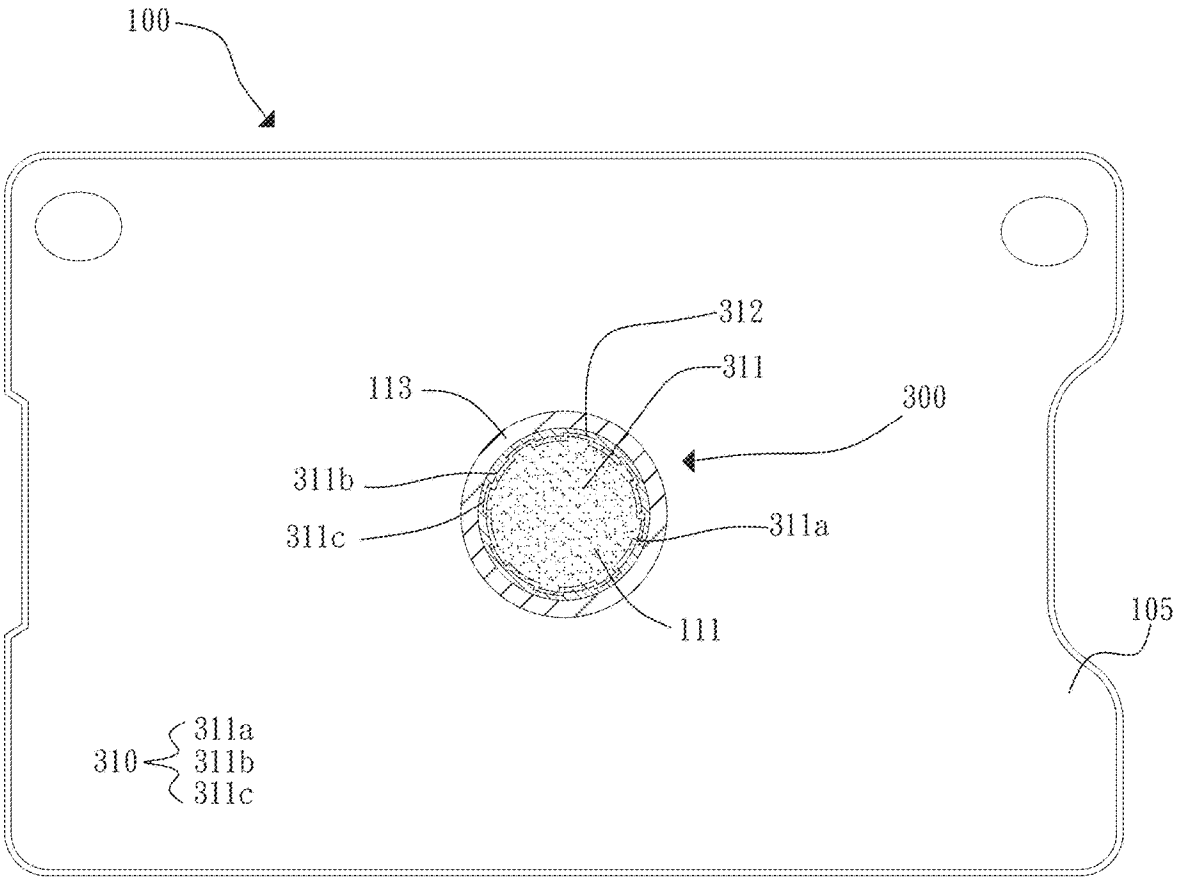
FIG. 14 is a top sectional view of a sixth embodiment of the heat dissipation device according to the present invention.
Figure 15:
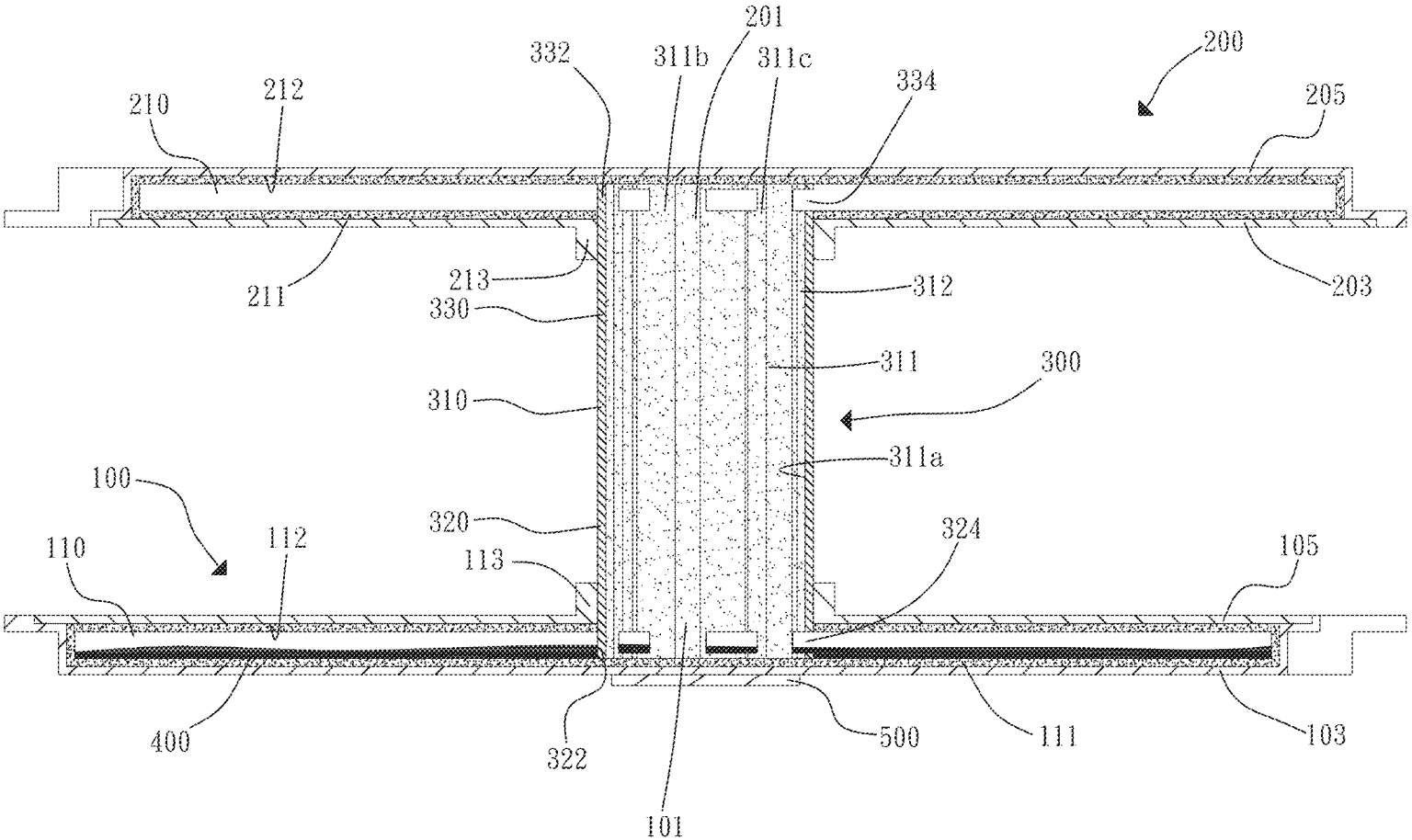
FIG. 15 is an assembled sectional view of the sixth embodiment of the heat dissipation device according to the present invention.

Please refer to FIGS. 14 and 15, which are top sectional and sectional views, respectively, of the heat dissipation device according to a sixth embodiment of the present invention, along with FIGS. 2 to 9, and FIGS. 12 to 13. As shown, the sixth embodiment of the heat dissipation base is generally structurally similar to the above embodiments except that, in this sixth embodiment, the pipe inner wall 311*a* has a plurality of protrusions 311*b*, which are spaced on an inner periphery thereof and extended axially and has at least one recess 311*c* in between. As shown in FIG. 14, the protrusions 311*b* are successively spaced like a gear, but not limited to it. The protrusions 311*b* can be arranged in uneven intervals and the recess 311*c* can also be other configurations. The pipe wick structure 312 is provided on surfaces of the protrusions 311*b* and the recesses 311*c* of the pipe body 310. The protrusions 311*b* and the recesses 311*c* give the pipe inner wall an increased area. With the increased area, the number of porous of the porous structure in the pipe wick structure 312 is also increased, such that the vapor-liquid circulation of the working fluid 400 in the first and the second chamber 110, 210 and the pipe chamber 311 occurs more frequently to enhance the overall heat dissipation efficiency.

Figure 16:
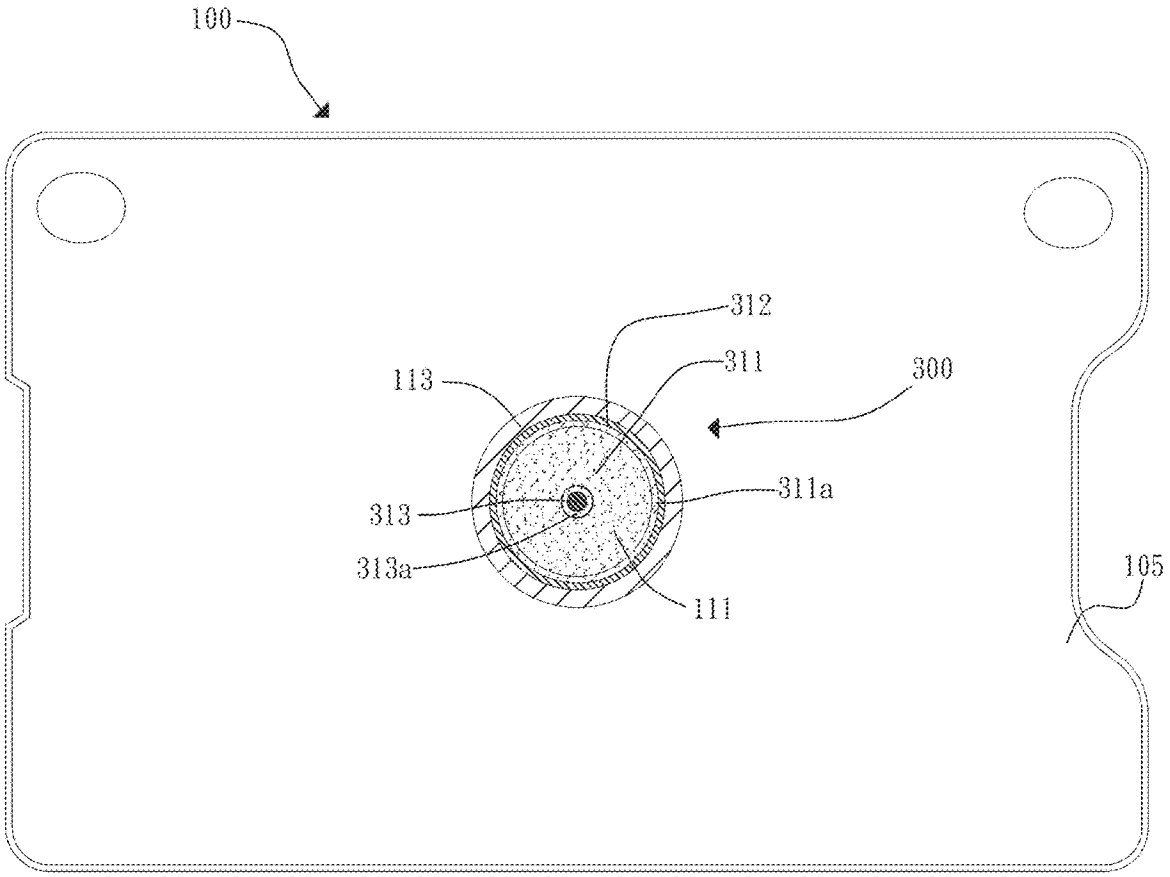
FIG. 16 a top sectional view of a seventh embodiment of the heat dissipation device according to the present invention.
Figure 17:
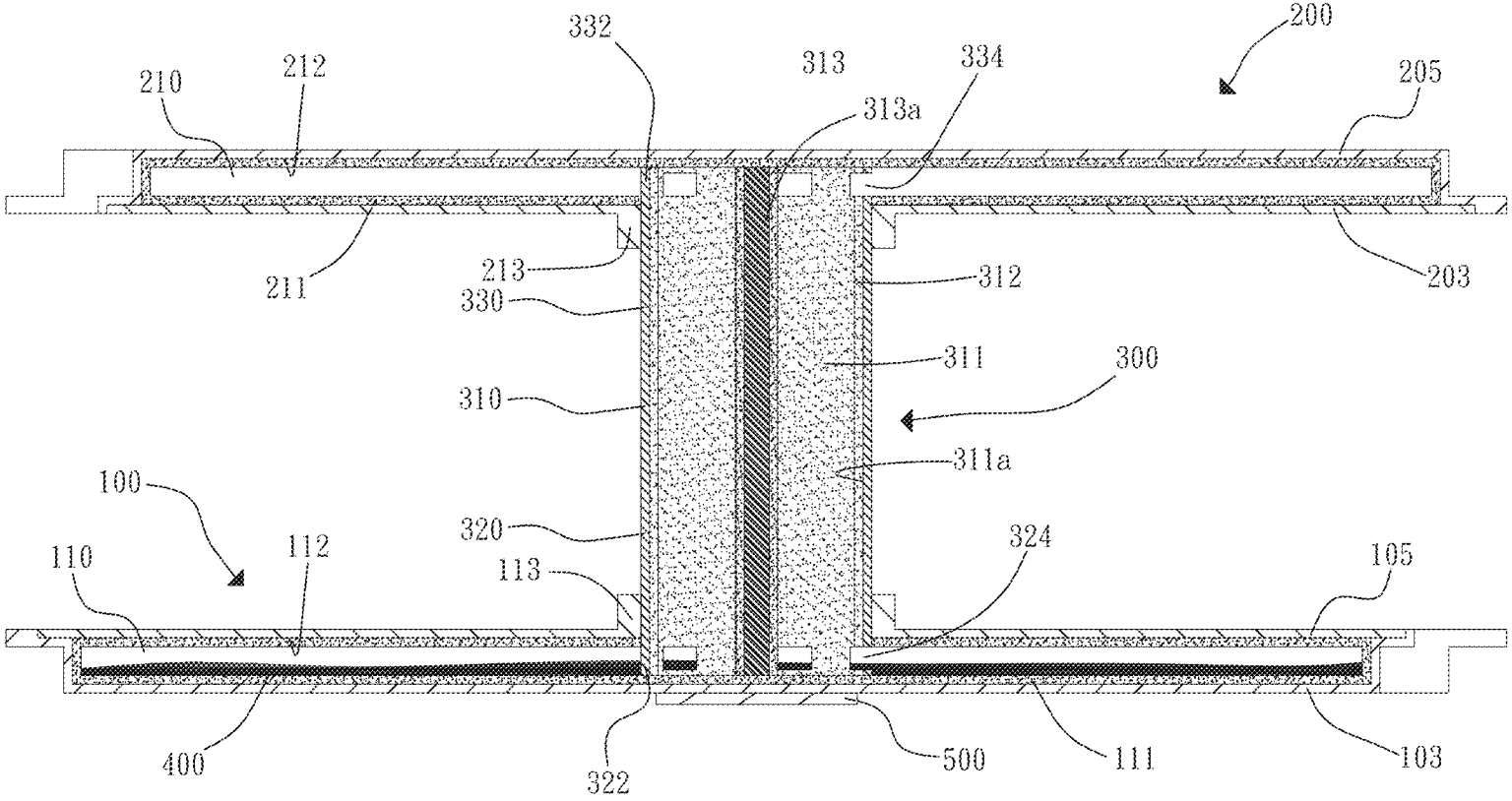
FIG. 17 is an assembled sectional view of the seventh embodiment of the heat dissipation device according to the present invention.

Please refer to FIGS. 16 and 17, which are top sectional and sectional views, respectively, of the heat dissipation device according to a seventh embodiment of the present invention, along with FIGS. 2 to 9, and FIGS. 12 to 15. As shown, the seventh embodiment of the heat dissipation base is generally structurally similar to the above embodiments except that, in this seventh embodiment, the pipe chamber 311 has a cylinder 313 located at a center thereof. The cylinder 313 has a first and a second top portion 313*a*, 313*b*, which is respectively extended and connected to the first and the second chamber 110, 210 on the first bottom side 103 and the second top side 205 of the first and the second housing 100, 200. The cylinder 313 is provided with a third wick structure 313*c* thereon. The third wick structure 313*c* is preferably but not limited to sintered powder structure; however; in practical implementation, it can be grid structure, fiber structure, braided structure, or any combination of thereof. Moreover, since the third wick structure 313*a* is connected to the first and the second wick structure 111, 211 of the first and the second housing 100, 200, the working fluid 400 in the first and the second wick structure 111, 211 can flow back via the third wick structure 313*a* other than flow back via the pipe wick structure 312, such that the vapor/liquid circulation of the working fluid 400 occurs more quickly in the first and the second chamber 110, 210, and the pipe chamber 311 to have enhanced heat transfer efficiency.

In brief, the heat dissipation device according to the present invention has the following advantages: (1) having no interface thermal resistance at junctures between the first and the second housing, and the pipe; (2) being manufactured at lower costs; (3) having enhanced heat transfer efficiency and good heat dissipation effect; (4) having increased vapor/liquid circulation effect; and (5) having faster heat dissipation speed.

The present invention has been described with some preferred embodiments thereof and it is understood that many changes and modifications in the described embodiments can be carried out without departing from the scope and the spirit of the invention that is intended to be limited only by the appended claims.

What is claimed is:

1. A heat dissipation device comprising:

a first housing having a first top side and a first bottom side, closed to each other, and internally defining a first chamber having a first wick structure provided therein and at least one first opening provided on a middle of the first top side and communicated with the first chamber;

a second housing having a second top side and a second bottom side, closed to each other, and internally defining a second chamber having a second wick structure provided therein and at least one second opening provided on a middle of the second bottom side and communicated with the second chamber;

at least one pipe having a pipe body, a first and second extended portion, a first and a second open end, and a first and a second through opening, and inserted into and connected to the first and the second chamber via the first and the second opening of the first and the second housing respectively; and the pipe body internally defining a pipe chamber, in which a pipe wick structure is formed, wherein the first open end of the pipe directly and perpendicularly presses against the first wick structure on the first bottom side of the first housing and the second open end of the pipe directly and perpendicularly presses against the second wick structure on the second top side of the second housing;

a working fluid provided in the first and the second chamber and the pipe chamber; and an open space defined between the first and second housings and the pipe.

2. The heat dissipation device as claimed in claim 1, wherein the first wick structure and the second wick structure are respectively formed on a first and a second housing inner wall of the first and the second housing, and selected from the group consisting of sintered powder structure grid structure, fiber structure, braided structure, and any combination thereof.

3. The heat dissipation device as claimed in claim 1, wherein the pipe wick structure is connected to the first and the second wick structure of the first and the second housing.

4. The heat dissipation device as claimed in claim 1, wherein the pipe wick structure is formed on a pipe inner wall of the pipe chamber and selected from the group consisting of sintered powder structure grid structure, fiber structure, braided structure, and any combination thereof.

5. The heat dissipation device as claimed in claim 4, wherein the pipe inner wall has a plurality of protrusions spaced on an inner periphery of the pipe and extended axially and having at least one recess in between; and the pipe wick structure is provided on surfaces of the protrusions and the recess of the pipe body.

6. The heat dissipation device as claimed in claim 1, wherein the pipe chamber has a cylinder located at a center; the cylinder has a first and a second top portion, which are respectively extended and connected to the first and the second housing, and is provided with a third wick structure thereon; the third wick structure connected to the first and the second wick structure of the first and the second housing; and the third wick structure is selected from the group consisting of sintered powder structure grid structure, fiber structure, braided structure, and any combination thereof.

7. The heat dissipation device as claimed in claim 1, wherein the first and the second through opening are respectively extended through both an inner and an outer wall of the pipe body, such that the pipe chamber is communicated with the first and the second chamber via the first and the second through opening.

8. The heat dissipation device as claimed in claim 1, wherein the pipe chamber is arranged between the first and the second open end.

9. The heat dissipation device as claimed in claim 1, wherein the first housing is a vapor chamber.

10. The heat dissipation device as claimed in claim 1, wherein the second housing is a vapor chamber.

11. The heat dissipation device as claimed in claim 1, wherein the pipe is a heat pipe.

* * * * *